United States Patent [19]

Dubberley

[11] 4,205,537

[45] Jun. 3, 1980

[54] MULTIPLE HERMETIC-MOTOR COMPRESSOR IN COMMON SHELL

[75] Inventor: Charles A. Dubberley, Tyler, Tex.

[73] Assignee: General Electric Company, Louisville, Ky.

[21] Appl. No.: 968,160

[22] Filed: Dec. 11, 1978

[51] Int. Cl.[2] ..... F25B 1/10

[52] U.S. Cl. ..... 62/510; 417/902

[58] Field of Search ..... 62/510; 417/902

[56] References Cited

U.S. PATENT DOCUMENTS

| | | | |
|---|---|---|---|
| 2,891,391 | 6/1959 | Kocher et al. | 62/473 |
| 3,386,262 | 6/1968 | Hackbart et al. | 62/510 |
| 3,449,922 | 6/1969 | Ruff et al. | 62/510 |
| 3,648,479 | 3/1972 | Richardson | 62/510 |
| 3,775,995 | 12/1973 | Conley et al. | 62/510 |
| 3,785,169 | 1/1974 | Gylland, Jr. | 62/510 |
| 4,102,149 | 7/1978 | Conley et al. | 62/510 |
| 4,105,374 | 8/1978 | Scharf | 62/510 |

*Primary Examiner*—Ronald C. Capossela

*Attorney, Agent, or Firm*—Frank P. Giacalone; Radford M. Reams

[57] ABSTRACT

A variable capacity multiple compressor refrigeration system having a hermetic shell containing a first compressor intended to be always running when the system is operating and a second compressor that may be cycled on and off when the system is operating. The separate compressors are mounted to provide a unitary structure resiliently isolated from the common shell. The compressors are arranged in the shell so that their lower bearing portions are always below the level of oil in the sump area of the shell. Both compressors are arranged in the system through common compressor shell inlet and discharge openings.

9 Claims, 4 Drawing Figures

MULTIPLE HERMETIC-MOTOR COMPRESSOR IN COMMON SHELL

BACKGROUND OF THE INVENTION

In the application of air conditioning and heat pump systems significant improvements in operating efficiencies are attained, especially in mild weather operation when the capacity of the equipment is reduced while utilizing all of the heat transfer surface of the system. It is well known to provide two or more compressors connected in parallel to a single refrigeration system, various ones of which may be cycled on and off to vary the capacity of the system.

When a plurality of compressors is connected in parallel in a single refrigeration system, as when there is a common suction line, oil circulating through the system with refrigerant may not be returned to the several compressors in the proper proportions. It may be necessary, therefore, to provide some arrangement for equalizing or distributing the oil among the several compressors. Generally, it is necessary to provide an oil equalizer line between crankcases of multiple compressors and connected at a predetermined height to the compressor that is always running when the system is in operation such that at least a minimum oil level at that height is maintained in that compressor when both compressors are running and that a suitable level of oil is maintained in the not-running compressor when only one compressor is running. Another problem arises when a cycled-off compressor is turned on to start running while another compressor running in the system has created a system pressure against which the starting compressor must start.

Another prior art system of providing capacity modulation is to employ one two-speed motor-compressor in a single shell. This arrangement solves the problems of oil distribution encountered in the multiple compressor systems and that of starting a second compressor against the pressure created by the running compressor. However, these systems do not provide optimum efficiency at all speeds and further require controls that are capable of switching motor speed.

It is an object of the present invention to provide a capacity modulating refrigerant system that employs a single shell compressor that has optimum efficiency at all running capacities.

SUMMARY OF THE INVENTION

In accordance with the present invention, there is provided a variable capacity multiple motor-compressor refrigeration system having a hermetic shell containing a first motor-compressor intended to be always running when the system is operating, and a second motor-compressor that may be cycled on and off when the system is operating. Each of the motor-compressors is of the type disclosed in U.S. Pat. No. 3,507,193-Jensen, assigned to General Electric, the assignee of the present invention, and includes a substantially closed crankcase that includes a cylinder opening into the crankcase. A reciprocating piston in the cylinder provides a compression chamber for compressing refrigerant gas which is received from the hermetic shell and for discharging hot refrigerant gas through a discharge port in the shell.

Positioned intermediate the upper and lower ends of shell is a frame member that is dimensioned so that its distal edge is spaced from said hermetic shell. The frame member is provided with a first opening for receiving the said first motor-compressor, and a second opening for receiving the second motor-compressor. The motor-compressors are positioned in their respective openings so that crankcase is arranged below the frame member. Holding means associated with said first and second openings secure the compressors against movement relative to the frame member and relative to each other to form a unitary and rigid structure. A plurality of support members is secured to and projects radially inwardly from the outer side wall of said hermetic shell to a position underlying the distal edge of the frame member. Interposed between the frame member and the support members are spring support elements that resiliently support the frame member relative to the hermetic shell. A first discharge line is connected between the first compressor discharge port to a discharge opening in the hermetic shell and a second discharge line is connected between the second compressor discharge port to the hermetic shell discharge opening.

DESCRIPTION OF THE PREFERRED EMBODIMENT

Figure 1:
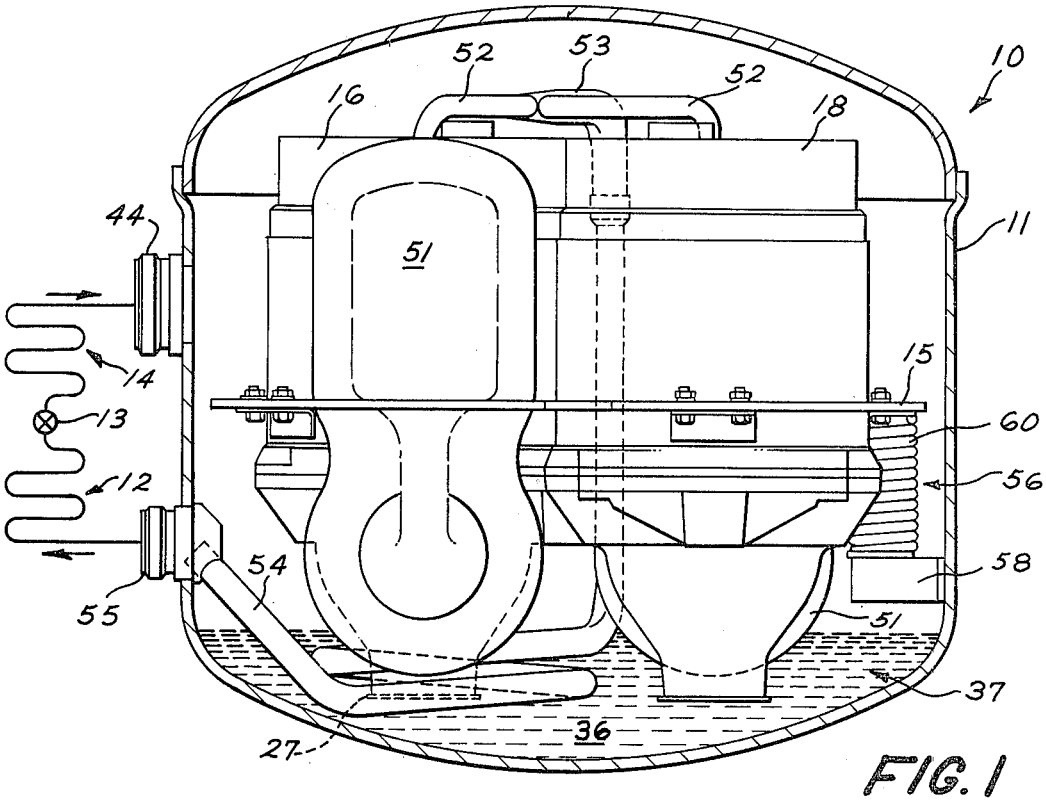
FIG. 1 is an elevational view illustrating a hermetic shell incorporating the motor-compressors of the present invention.

In the present embodiment two motor-compressors are shown in a common shell; it should be noted, however, that more than two may be arranged in a common shell depending on the number of capacity variations required.

Referring now to the drawings, there is illustrated a hermetic motor-compressor unit 10 comprising a shell or casing 11 in which is resiliently mounted a support member or plate 15 supporting a first motor-compressor 16 of a certain capacity intended to be always running when the system is operating, and a second motor-compressor 18 of another capacity that may be cycled on and off when the system is operating.

The motor-compressor unit is designed to form a part of a hermetic refrigeration system including, as diagrammatically illustrated in FIG. 1, a condenser 12, an expansion device which may be either an expansion valve as shown or a capillary tube 13 and an evaporator 14 connected in closed series flow relationship.

The motor-compressors 16 and 18 employed in the present invention are of the type disclosed fully in U.S. Pat. No. 3,507,193-Jensen, assigned to General Electric, the assignee of the present invention. The motor-compressors may be of different capacities to allow three capacity steps. Generally, the motor-compressors 16 and 18 are identical except for compressor displacement and motor horsepower and, accordingly, only one compressor 16 which is always running when the system is operating will be described in detail with the numbered parts being applied to both. The units comprise a compressor block 20 defining a substantially closed crankcase 23 and a cylinder 24 opening into the crankcase. The compressor block 20 also includes upper and lower axially aligned bearings 26 and 27 in which is mounted a vertically extending shaft 28 having an eccentric bearing portion 29 between bearings 26 and 27. A connecting rod 30 connects a piston 31 to the bearing 29. This piston 31 reciprocates or slides back and forth in the cylinder 24 in response to the reciprocating forces provided by the eccentric bearing 29 upon rotation of the shaft 28.

Means for driving the compressor comprises a sleeve 32 housing an electric motor 34 positioned in the upper portion of the shell 11 above the compressor block 20 and having a rotor 35 attached to the shaft 28.

The bottom of the shell 11 defines a sump 36 for containing a body of lubricating oil 37 used to lubricate the various bearings of both compressors 16 and 18. This body of lubricant is preferably of a sufficient depth that the lower end of the crankcase of both compressors, including their oil pumps at the lower end of bearings 27, is substantially immersed in the oil 37 and is lubricated by such immersion.

During operation of the system with one or both compressors running, low pressure or suction gas is withdrawn from the evaporator 14 through a suction inlet 44 positioned generally in the upper portion of the shell 11. This relatively cool suction gas entering inlet 44 passes downwardly through the motor 34 and through a plurality of holes 45 into an annular suction muffler 46 formed in the upper portion of the compressor block 20. The suction gas flows from the muffler 46 through one or more horizontal passages 47 into an annular cavity 48 surrounding the forward end of the cylinder 24. From the cavity 48 refrigerant then flows through a plurality of suction portions 49 and a suction valve (not shown) into the interior or compression chamber 50 of the cylinder 24.

Refrigerant compressed by the reciprocating piston 31 flows through a discharge valve (not shown) and into the cylinder head and discharge muffler 51. From discharge muffler 51 the hot refrigerant gas flows into a discharge line 52 which, in turn, is connected to a common discharge line 53. The discharge line 53 includes a plurality of loops 54 immersed in the body of oil 37 and is thereafter discharged from the shell 11 through a discharge outlet 55 to the condenser 12. As mentioned hereinabove, the second compressor 18 is identical except for capacity to the compressor 16 just described and when running refrigerant compressed therein flows through its associated muffler 51 and discharge line 52 which is connected into the common discharge line 53.

In accordance with the present invention, the compressors 16 and 18 are rigidly mounted to form a unitary structure that is resiliently mounted in shell 11 with the lower portion arranged so they each will draw lubricant 37 from the common sump 36. To this end, the supporting frame or member 15 is dimensioned so that its radially disposed distal edge is spaced from the inner wall of the shell and is supported on the shell 11 intermediate the suction inlet 44 and discharge outlet 55 by a plurality of resilient support elements 56. In the present embodiment the support elements 56 each include a bracket 58 secured to the inner wall of shell 11 that projects radially inwardly to a position underlying the outer edge portion of member 15. Interposed between the brackets 58 and the under side of member 15 are springs 60 which are held in place by fastening means 62. While in the present embodiment, four equally spaced support elements as shown serve to form the proper resilient support and isolation between the compressors and shell, it should be understood that the exact number and arrangement may vary with compressor capacity and design.

The system for rigidly mounting the compressors 16 and 18 to the support member 15 to form a unitary structure includes a pair of apertures 64 and 66 that are dimensioned to receive the compressors 16 and 18 respectively and a plurality of brackets 58. The brackets 58 are secured to the shell of the compressors 16 and 18 and include a projecting portion that is secured to the support member 15 in a manner that prevents movement of the compressor relative to the member 15. Additional fastening means (not shown) may be provided at the upper extremities of the motor-compressor housing if necessary to effect the desired rigidity.

Figure 4:
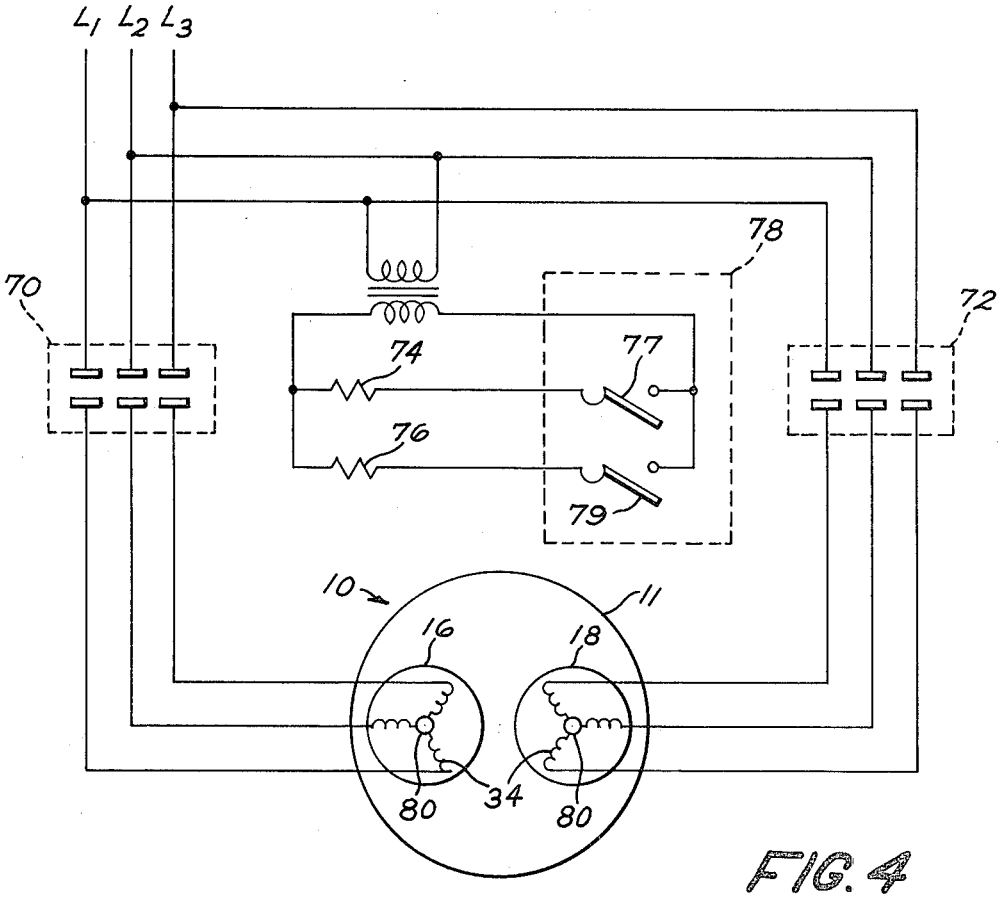
FIG. 4 is a wiring diagram.
Figure 2:
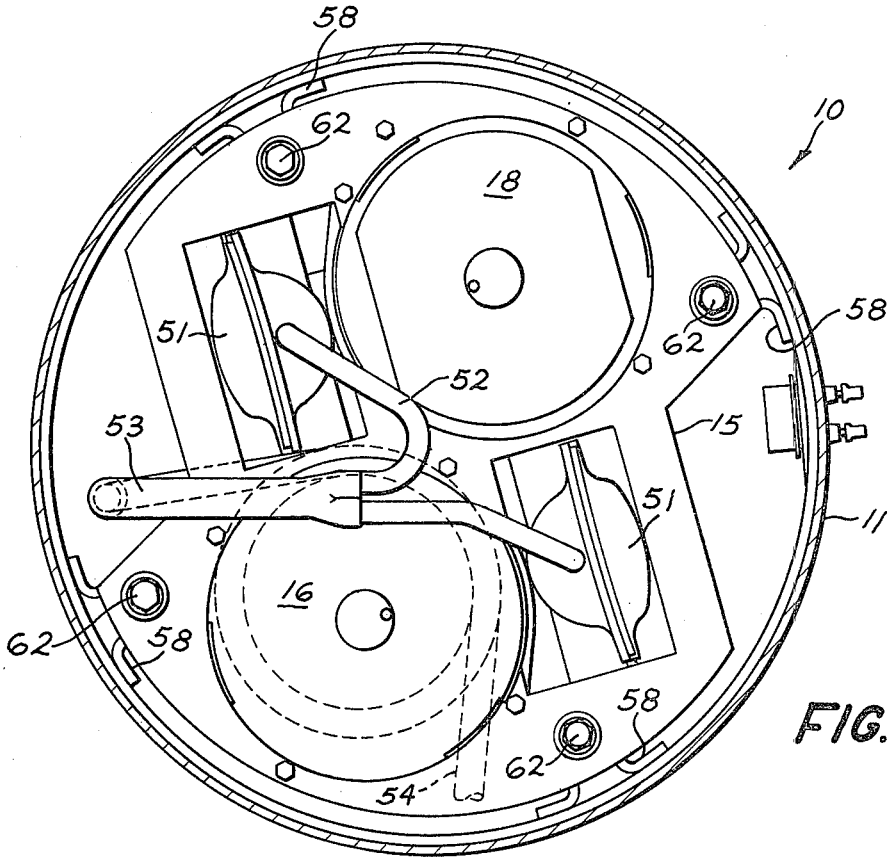
FIG. 2 is a top plan view taken along lines 2—2 of FIG. 1.
Figure 3:
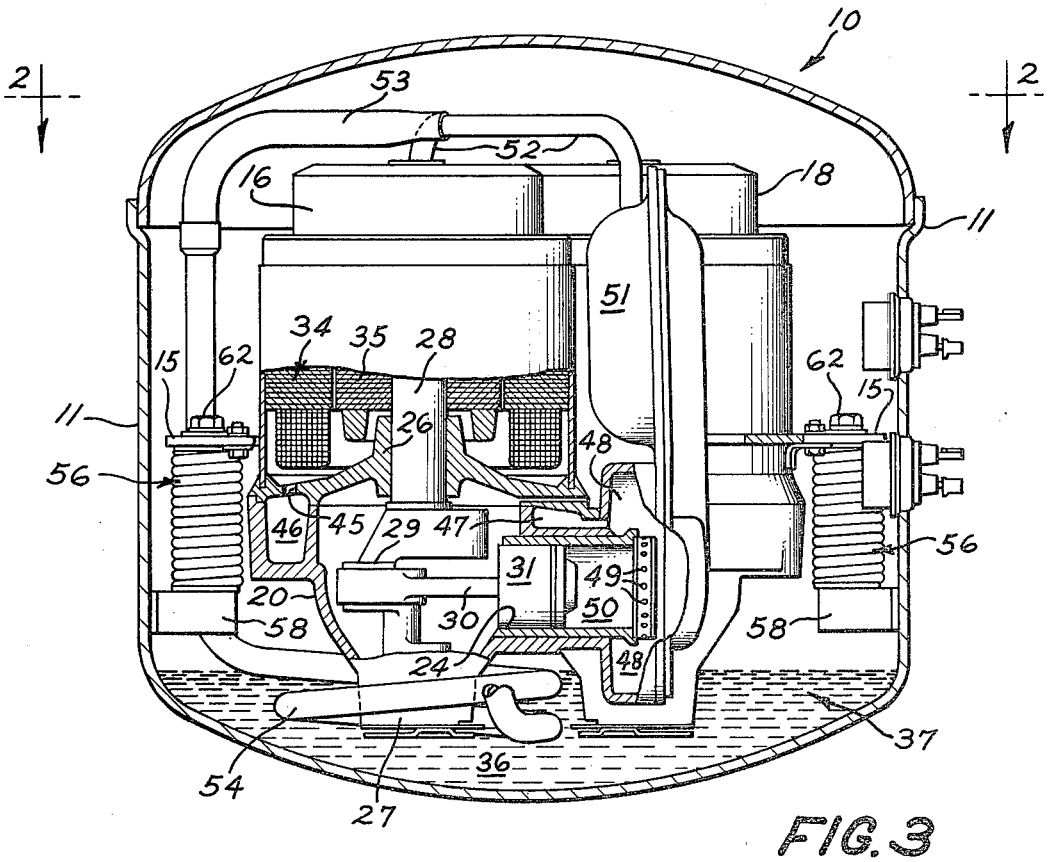
FIG. 3 is an elevational view similar to FIG. 1 with parts broken away and in section.

With reference to FIG. 4, there is shown a typical control circuit for the dual hermetic compressor 10 disclosed in the present embodiment. Power to each compressor 16 and 18 in the common shell 11 is supplied through lines L1, L2, L3. As shown, the lines to the motor-compressors 16 and 18 are provided with motor controller switches 70 and 72 that are operated by low voltage relays 74 and 76 respectively. The relay 74 is energized through a first stage switch 77 of a thermostat 78. When additional cooling or heating is required, the second relay 76 is energized through the second stage switch 79 of the thermostat. Accordingly, the compressor 16 will always be running when the system is operating with the compressor 18 being energized as the demand for heating or cooling increases. The motors 16 and 18 may be provided with motor protective means 80 which are designed to prevent overheating due to failure to start or other malfunction.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A variable capacity multiple compressor refrigeration system comprising:

a hermetic shell containing a first motor-compressor intended to be always running when the system is operating and a second motor-compressor that may be cycled on and off in combination with said first motor-compressor;

said motor-compressors each including a substantially closed crankcase, a cylinder opening into said crankcase and a reciprocating piston in said cylinder providing a compression chamber for compressing refrigerant gas receiving from said hermetic shell and for discharging hot refrigerant gas through a discharge port;

a frame member dimensioned so that its distal edge is spaced from said hermetic shell;

a first opening in said frame member for receiving said first motor-compressor, and a second opening in said frame member for receiving said second motor-compressor, with the crankcase portion of said compressor arranged below said frame member;

holding means associated with said first and second openings for securing said motor-compressors against movement relative to said frame member to form a rigid unitary structure;

a plurality of support members secured to and projecting from the wall of said hermetic shell to a position underlying the distal edge of the frame member;

spring support elements interposed between said frame member and said support members for resiliently supporting said frame member;

a first line connected between said first compressor discharge port to a discharge opening in said hermetic shell;

a second line connected between said second compressor discharge port to said hermetic shell discharge opening.

2. The invention of claim 1 wherein said hermetic shell includes an intake and discharge opening connected in closed series connection with a sealed refrigerant system evaporator flow control device and condenser.

3. The invention of claim 2 wherein said hermetic compressor includes a sump area arranged below said discharge opening for containing an amount of lubricating oil.

4. The invention of claim 3 wherein said frame member is arranged in said hermetic shell intermediate said intake and discharge openings.

5. The invention of claim 4 wherein said discharge line includes a resilient loop portion arranged in said sump.

6. The invention of claim 5 wherein said motor-compressors are arranged in said frame member so that the lower portions of said first and second compressors are immersed in said oil.

7. The invention of claim 6 wherein electrical leads and terminals are provided for said first and second motor-compressors to allow energizing either one independently of the other.

8. The invention of claim 7 wherein separate motor protective means are provided in said first and second motor-compressors.

9. The invention of claim 1 wherein at least two motor-compressors are included in the assembly within the single hermetic shell with single oil sump.

* * * * *